United States Patent [19]

Austin

[11] 4,387,804

[45] Jun. 14, 1983

[54] CONVERTIBLE PILL CUP PACKAGE

[75] Inventor: John J. Austin, Elkhart, Ind.

[73] Assignee: Champion International Corporation, Stamford, Conn.

[21] Appl. No.: 346,512

[22] Filed: Feb. 8, 1982

Related U.S. Application Data

[63] Continuation of Ser. No. 171,392, Jul. 23, 1980, abandoned.

[51] Int. Cl.[3] ..... B65D 77/00

[52] U.S. Cl. ..... 206/218; 206/569; 206/219; 206/530; 206/828; 229/1.5 B; 206/217

[58] Field of Search ..... 206/217, 218, 219, 530, 206/531, 494, 37, 828; 229/1.5 B, 1.5 R

[56] References Cited

U.S. PATENT DOCUMENTS

| | | | |
|---|---|---|---|
| 1,025,937 | 5/1912 | Von Vargyas et al. | 229/1.5 B |
| 2,475,294 | 7/1949 | Rafoth | 229/1.5 R |
| 3,526,317 | 9/1970 | Vanders | 206/217 |

FOREIGN PATENT DOCUMENTS

| | | | |
|---|---|---|---|
| 37930 | 7/1909 | Fed. Rep. of Germany | 206/218 |

*Primary Examiner*—Joseph Man-Fu Moy

*Attorney, Agent, or Firm*—Evelyn M. Sommer; William W. Jones; John H. Mullholland

[57] ABSTRACT

A package for containing a preselected amount of a product in the form of a pill or the like is adapted to be converted for use as a cup for containing liquid and includes a pair of sidewalls made of paperboard which are joined together along three mutual edges thereof, the fourth mutual edges defining the top of the cup. A support flap is connected by a perforated score line along an edge of one of the sidewalls at the top of the cup and has a plastic blister bonded to one face thereof within which a pill or other product may be contained. The support flap is provided with an aperture therein registering with the interior of the blister and a frangible closure, preferably a metal foil, is secured in overlapping relationship to the aperture to prevent loss of the product prior to the time of use. Spaced fold lines in the sidewalls allow folding of the package to a compact condition for storage, and the support flap may be torn away from the top of the cup during use to allow ready access to the product.

1 Claim, 20 Drawing Figures

Fig. 6.
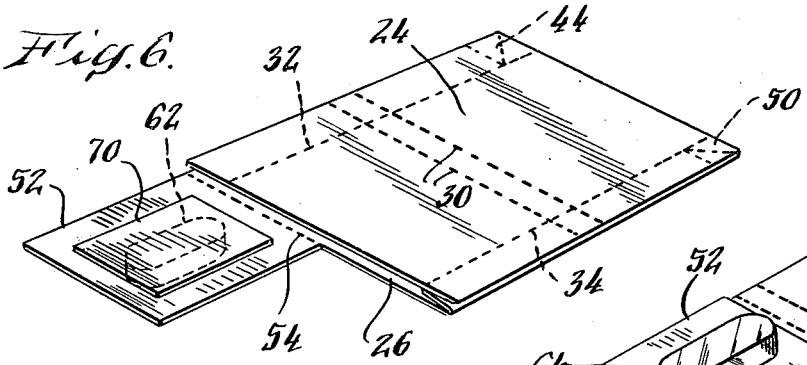
Fig. 7.
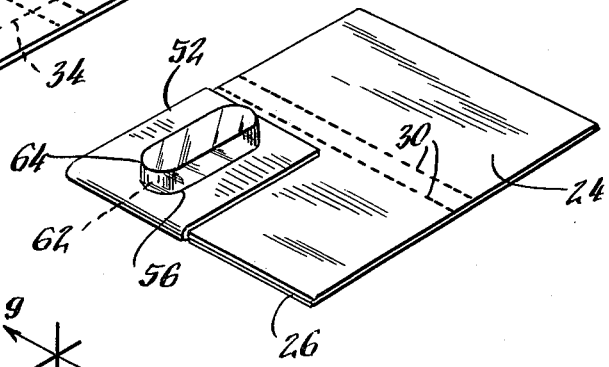
Fig. 8.
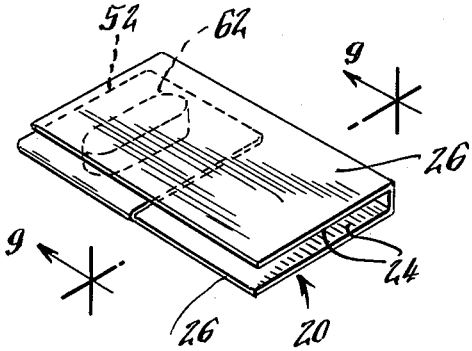
Fig. 9.
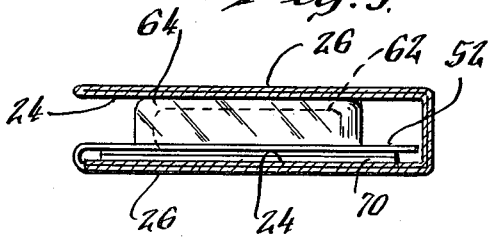
Fig. 10.
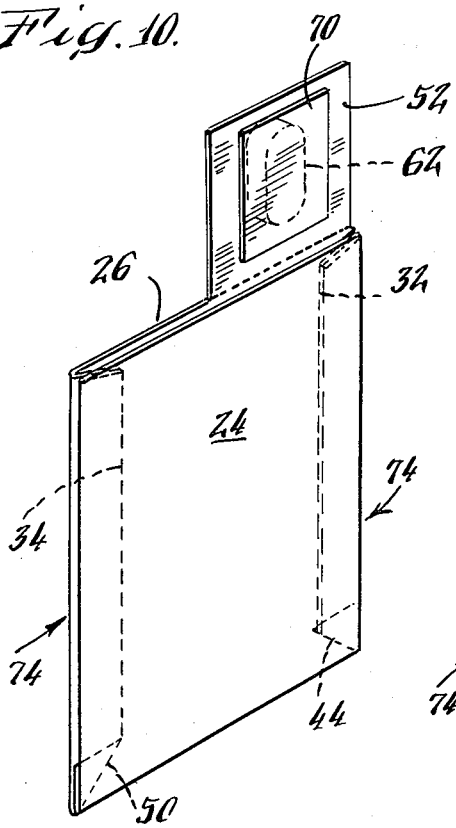
Fig. 11.
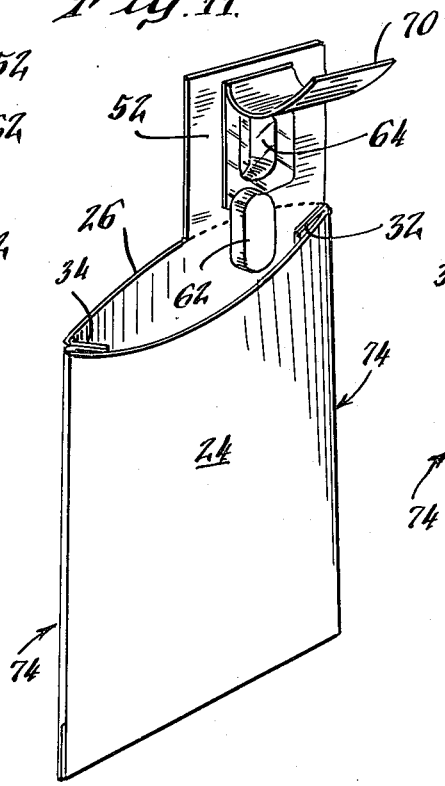
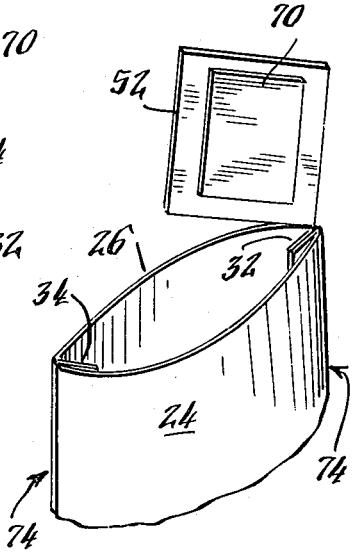
Fig. 12.

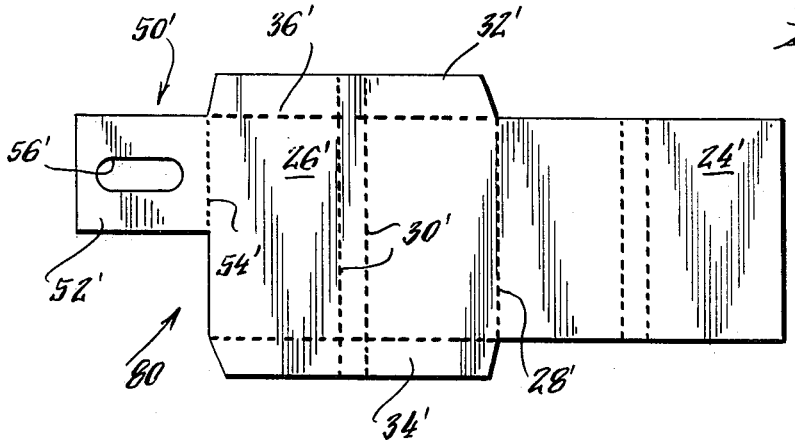
Fig. 16.
Fig. 17.
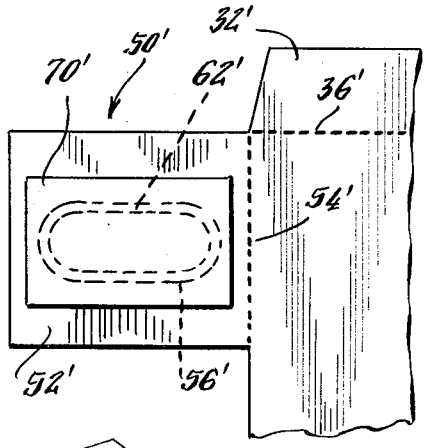
Fig. 19.
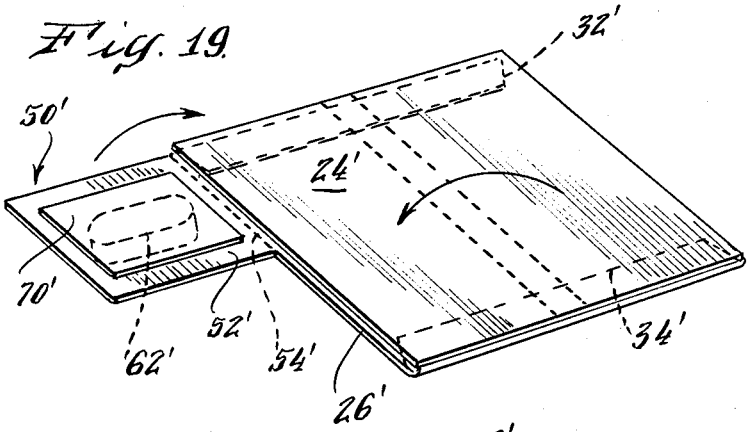
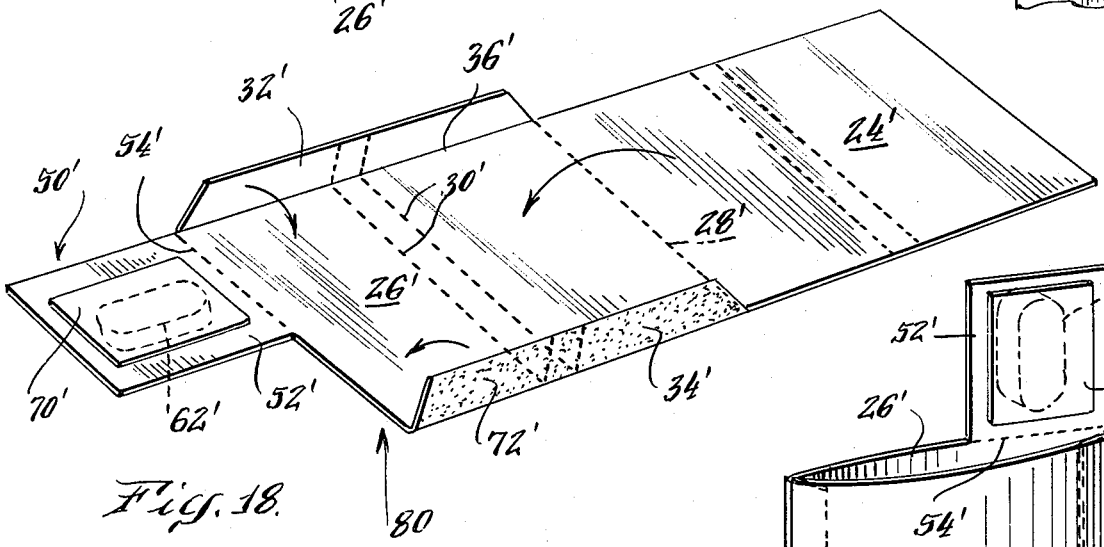
Fig. 18.
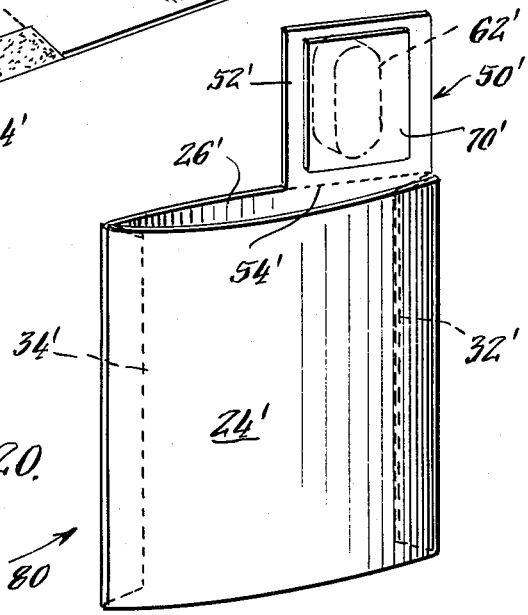
Fig. 20.

CONVERTIBLE PILL CUP PACKAGE

This is a continuation of application Ser. No. 171,392, filed July 23, 1980, now abandoned.

TECHNICAL FIELD

The present invention deals generally with the packaging art, and relates more particularly to a novel package and blank therefor for packaging premeasured amounts of a product, such as medicament, which may be converted for use as a drinking cup.

BACKGROUND AND BRIEF DESCRIPTION OF THE INVENTION

In the past, products which are consumed orally, such as pills or other medication, have been packaged individually in plastic blister type packs. Often, the consumer may carry an individual prepackaged pill on his or her person in order to consume the pill at some point during the course of the day. Because pills and other small dosages of medication are sometimes small, individual pills may be lost from pockets, purses, etc.

In any event, it is normally necessary for the consumer to drink a quantity of fluid such as water to facilitate swallowing of the pill. Many sources of drinking fluids require the use of a drinking cup, however, a drinking cup may not always be available to the consumer at the particular time of day or night when the medication is to be taken. The consumer is therefore faced with the choice of locating a drinking cup at the point in time which the medication is to be taken or carrying a portable cup for this purpose.

Accordingly, it is a primary object of the present invention to provide a package for containing a preselected quantity of product, such as a pill, which may be easily and quickly converted for use as a drinking cup.

A further object of the present invention is to provide a package to the type described above in which a portion of the package enclosing the product may be removed from the remaining part of the package which defines the cup.

A still further object of the invention is to provide a package of the type described above which may be folded into a compact condition to facilitate storage and transport thereof prior to use.

Another object of the invention is to provide a package of the type described in which access is provided to the product without the need for tearing or cutting of paperboard or pivoting of flap members.

Still another object of the invention is to provide a package as described above in which the product may be secured to the package at rapid production rates without the need for folding the package about the product.

These and further objects of the invention will be made clear or will become apparent during the course of the following description. In accordance with the present invention, a package for containing a preselected amount of a product in the form of a pill or the like, is adapted to be converted for use as a cup for containing liquid and includes a pair of sidewalls made of paperboard which are joined together along three mutual edges thereof, the fourth mutual edges defining the top of the cup. A support flap is connected by a perforated score line along an edge of one of the sidewalls at the top of the cup and has a plastic blister bonded to one face thereof within which a pill or other product may be contained. The support flap is provided with an aperture therein registering with the interior of the blister and a frangible closure, preferably a metal foil, is secured in overlapping relationship to the aperture to prevent loss of the product prior to the time of use. Spaced fold lines in the sidewalls allow folding of the package to a compact condition for storage, and the support flap may be torn away from the top of the cup during use to allow ready access to the product.

DESCRIPTION OF THE DRAWINGS

In the drawings, which form an integral part of the specification and are to be read in conjunction therewith, and in which like parts are designated by like numerals in the various views:

FIGS. 4–7 are perspective views showing the sequential steps for folding the blank of FIG. 1 in order to form the package;

FIG. 8 is a perspective view of the package of the present invention in a completely folded, compact condition;

FIG. 9 is a sectional view taken along the line 9—9 in FIG. 8;

FIG. 10 is a perspective view of the package in an unfolded condition immediately prior to use;

FIG. 11 is a view similar to FIG. 10 but showing the closure lifted away from the support flap to allow a pill to fall from the blister into the cup;

FIG. 12 is a fragmentary view similar to FIG. 11, but showing the support flap being torn away from the cup;

FIG. 16 is a plan view of an alternate form of blank for forming a portion of the convertible pill cup package;

FIG. 17 is a fragmentary plan view of the blank of FIG. 16 showing the support flap after the product has been attached thereto; and FIGS. 18 to 20 are perspective views showing the sequential steps for folding the blank of FIG. 16 in order to form the package.

DETAILED DESCRIPTION OF THE INVENTION

Figure 1:
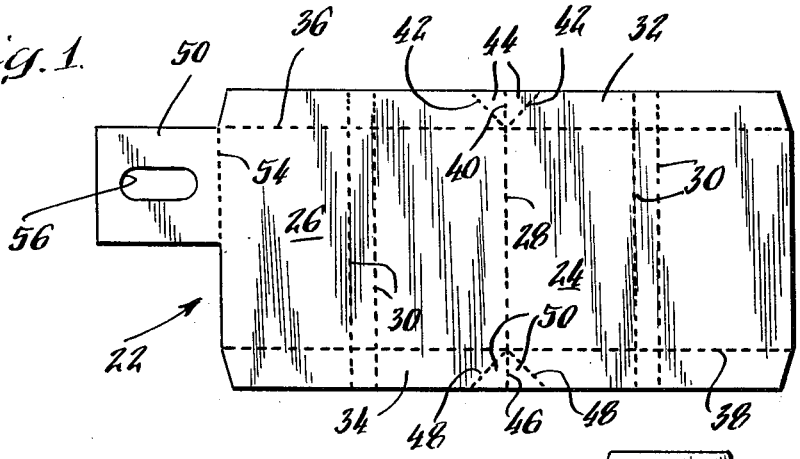
FIG. 1 is a plan view of a blank for forming a portion of the convertible pill cup package which comprises the preferred embodiment of the present invention.

Referring now to the drawings, a package for containing a preselected amount of product therein which may be converted for use as a drinking cup is generally indicated by the numeral 20. The package 20 is formed in part from a unitary pre-cut blank of paperstock designated by the numeral 22 in FIG. 1. The blank 22 includes a pair of rectangularly shaped sidewalls 24 and 26 joined along one mutual edge thereof by fold line 28.

Each of the sidewalls 24 and 26 has a pair of laterally spaced, parallel fold lines 30 in intermediate regions thereof which extend essentially parallel to the fold line 28. Upper and lower, rectangularly shaped panels 32 and 34 are respectively joined along the upper and lower edges of sidewalls 24 and 26 by corresponding fold lines 36 and 38. Panel 32 includes a vertical fold line 40 extending colinear with fold line 28, and further includes a pair of fold lines 42 diverging outwardly from the intersection of fold lines 36 and 40 to spaced apart locations along the outer edge of panel 32, essentially equidistant from fold line 40 to define a pair of triangularly shaped tuck flaps 44. Similarly, panel 34 is provided with a vertical fold line 46 which extends colinear with the fold line 28. Panel 34 also includes a pair of fold lines 48 diverging outwardly from the intersection of fold lines 46 and 38 to spaced apart points along the outer edge of panel 34, thereby defining a pair of triangular tuck flaps 50.

Blank 22 further includes a rectangularly shaped support flap 52 joined along the outer lateral edge of sidewall 26 by a fold line 54. Support flap 52 is provided with an elongated aperture 56 therein. The upper edge of support flap 52 extends essentially colinear with the fold line 36, while the lower horizontal edge thereof is spaced approximately mid-way between fold lines 36 and 38.

Figure 3:
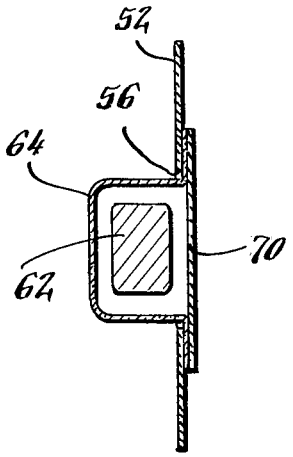
FIG. 3 is a sectional view taken along the line 3—3 in FIG. 2.
Figure 2:
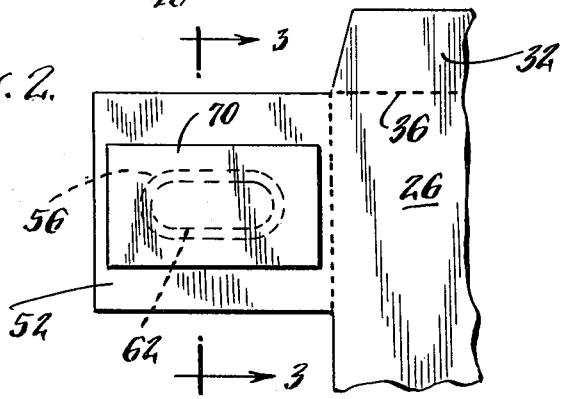
FIG. 2 is a fragmentary plan view of the blank of FIG. 1 showing the support flap after the product has been attached thereto.
Figure 4:
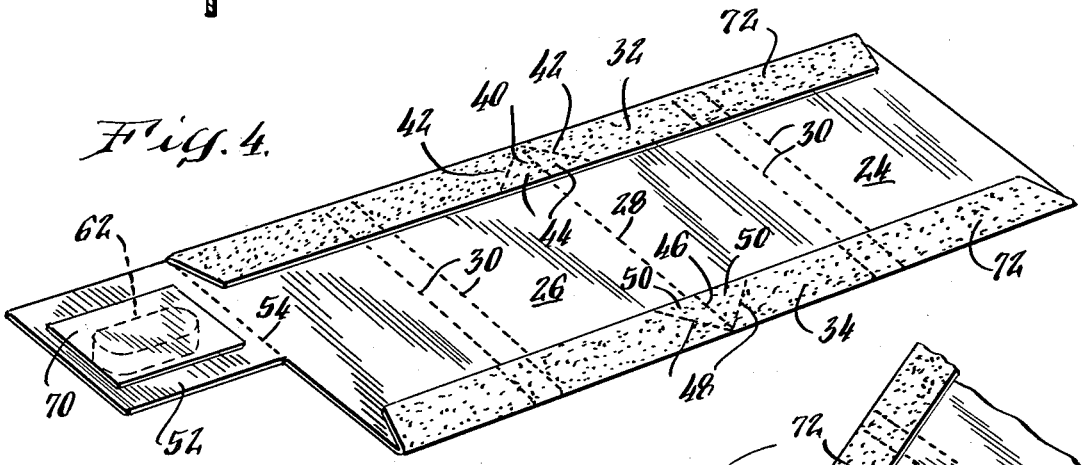
Figure 5:
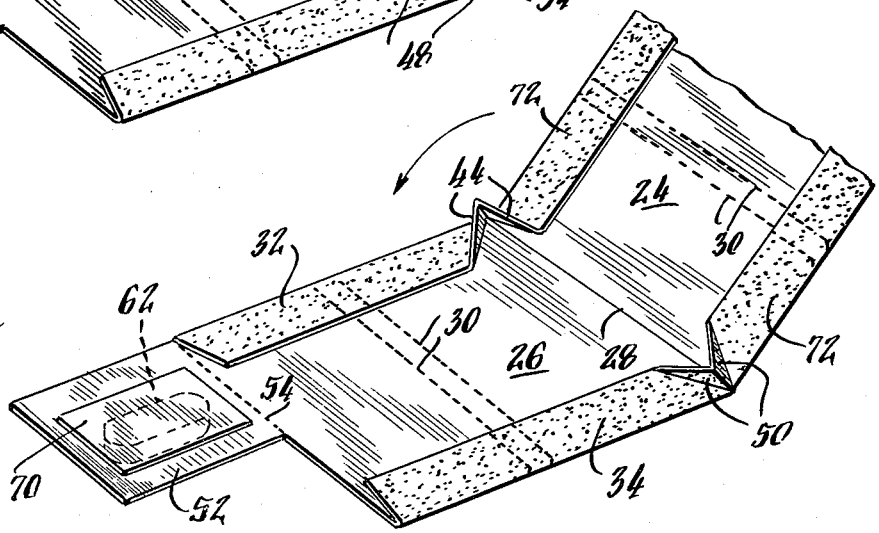
Figure 13:
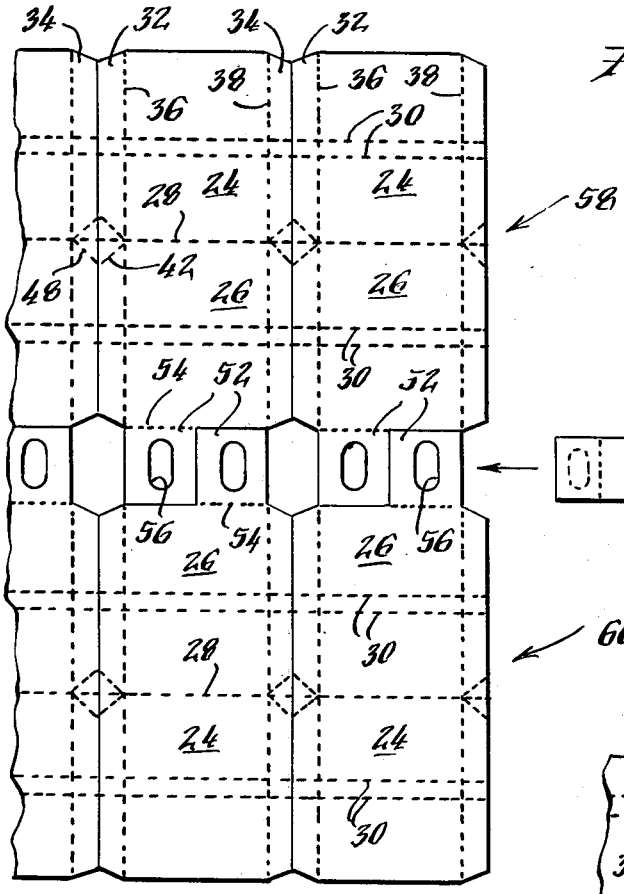
FIG. 13 is a fragmentary plan view of a nesting arrangement for cutting a plurality of the blanks of FIG. 1 from a master sheet, along with a strip of prepackaged products prior to attachment of the strip of the blanks.

A plurality of the blanks 22 may be simultaneously diecut from a unitary blank of paperstock using the nesting arrangement shown in FIG. 13 wherein the blanks 22 are arranged in aligned rows 58 and 60, with the blanks in row 60 being inverted 180 degrees relative to the blanks in row 58 such that the apertures 56 of the support flaps 52 are horizontally aligned. A product is attached to each of the blanks 22 prior to folding thereof by means of pre-packaging the product in a manner shown in FIGS. 2, 3 and 13. Each of the products, herein indicated as a capsule or pill, 62 is inserted into an enclosure formed by a bubble-like blister 64 which includes a flat flange surrounding the periphery thereof. The blisters may be produced from thermo-formed plastic in a continuous strip 66 thereof separated by preformed lines of weakness 68. After the pills 62 are inserted into the blisters 64, closure means, preferably comprising a metal foil 70 is adhesively secured to the back side of each of the blisters 64 thereby enclosing the corresponding pills 62. The strip 66 filled with product may then be superimposed over the nested blanks 22 in alignment with the apertures 56. Adhesive (not shown) is then applied to the support flap 52 around the aperture 56 which bonds the unit comprising the blister 64, pill 62 and metal foil 70 to one face of the support flap 52. The blanks 22 may then be further cut or separated and each folded in a manner which will now be described.

Panels 32 and 34 are first pivoted inwardly 180° into overlapping relationship with the sidewalls 24 and 26. Adhesive 72 is then applied to the exposed faces of panels 32 and 34, including each pair of the tuck flaps 50.

Next, sidewalls 24 and 26 are pivoted 180° about fold line 28 in a manner to fold the panels 32 and 34 in half, thereby securing the opposing faces of the opposite halves of the panels 32 and 34 to each other. Simultaneous with the last step discussed above, tuck flaps 44 and 50 are pivoted upwardly away from the sidewalls 24 and 26 about fold lines 42 and 48 and toward each other about the associated fold lines 40 and 46 such that each pair of these tuck flaps are disposed in overlapping relationship to each other and in sandwiched relationship between the opposing halves of the panels 32 and 34. At this point, it may be appreciated that the blank has been folded into the form of an expandable packet or envelope.

The support flap 52 is then pivoted 180° inwardly into overlapping relationship to the outer face of sidewall 24. As best seen in FIG. 7, the support flap 52 extends to a point just short of the pairs of fold lines 30. Approximately one half of each of the sidewalls 24 and 26 is next pivoted about the pairs of fold lines 30 into overlapping relationship to the support flap 52 and the remaining half of such sidewalls to form a compact package with the pill 62 protectively interposed between facing halves of the sidewalls 24 and 26 as shown in FIG. 8.

In use, a consumer may carry the package 20 in the compact position shown in FIG. 8 without fear that the cup and pill 62 may become separated and lost. When ready for use, the consumer unfolds the package to the condition thereof shown in FIG. 10 and may proceed in either of two ways. First, he may tear away the support flap 52 from sidewall 26 along fold line 54 and then peel or puncture the metal foil 70 at the aperture 56 to gain access to the pill 62. The pill 62 may then either be taken orally or dropped into the cup and the support flap 52 is discarded. The remaining portions of the package 20 are converted to a drinking cup simply by parting the sidewalls 24 and 26; this may be done by applying inwardly directed pressure with the fingers on the opposite lateral edges 74 of the package 20. As the sidewalls 24 and 26 are parted, a drinking vessel or cup is formed which may then be filled with a liquid which may be drunk by the consumer to facilitate swallowing of the pill.

Alternately, the consumer may peel or puncture the foil 70 and remove the pill 62 before the flap 52 is separated from the package 20, as shown in FIGS. 11 and 12; in this case, the flap 52 is merely pivoted toward the opening between the sidewalls 24 and 26 in order to automatically guide and drop the pill 62 into the cup. The flap 52 is then removed from the package 20 and the cup may be filled with liquid.

Note that a substantially liquid-tight enclosure is formed by the remaining portion of the package 20 by virtue of the substantial sealing area between opposite faces of the panels 32 and 34. Additionally, prevention of leakage of liquid from the package 20 at the lower corners thereof is substantially enhanced as a result of the tuck flaps 44 and 50 which are joined to the panels 32 and 34 as well as to each other by fold lines.

It is to be recognized that the blister 64 may be filled with a liquid or granulator type product which is deposited directly into the interior of the cup portion of the package 20 along with the liquid, as discussed above. In this case, elderly or feeble consumers who might otherwise have difficulty pouring the contents of the blister 64 into the cup may consistently and reliably add medicaments to drinking fluids without assistance.

Because of its compact nature, the package 20 is well suited for being individually dispensed from a plurality thereof. This can be accomplished by stacking a number of the packages 20 in the compact condition thereof within a dispenser 76. Dispenser 76 comprises a rectangularly shaped container having a slot-like opening 78 in one face thereof at the bottom of the dispenser. The packages 20 may be removed one-at-a-time through the dispensing opening 78 and the remaining packages shift downwardly by their own weight toward the opening 78.

In lieu of blank 22, the package 20 can be formed using an alternate blank 80 illustrated in FIG. 16. Blank 80 is devoid of the tuck flaps 44, 50 used in blank 22, and as a consequence may not be as sturdy and leak-proof, but is simpler to fold, particularly on automatic machinery. Elements of blank 80 corresponding to those of blank 22 are indicated by the corresponding primed numerals.

As illustrated in FIG. 16, the blank 80 includes a pair of rectangularly shaped sidewalls 24', 26' joined along a mutual edge thereof by a fold line 28'. Each of the sidewalls 24' and 26' has a pair of laterally spaced, parallel fold lines 30' in intermediate regions thereof which extend essentially parallel to the fold line 28'. Upper and lower, rectangularly shaped panels 32' and 34' are respectively joined along the upper and lower edges of sidewalls 26' only by fold lines 36' and 34', rather than having a portion joined to the upper and lower edges of sidewall 24', as in blank 22.

As in blank 22, blank 80 also includes a rectangularly shaped support flap 52' joined along the outer lateral edge of sidewall 26' by a fold line 54'. Flap 52' is provided with an opening 56' to receive a pill 62' as in blank 22.

In folding blank 80, panels 32' and 34' are first pivoted 180° into overlapping relationship with the sidewalls 24' and 26'. Adhesive 72' is applied to the exposed faces of panels 32' and 34'.

Next, sidewall 24 is pivoted 180° about fold line 28' securing the panels 32' and 34' to the upper and lower edges, respectively of sidewall panel 24' to form an expandable envelope.

Figure 14:
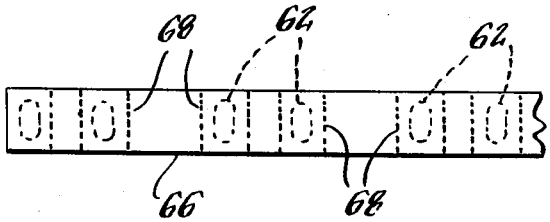
FIG. 14 is a fragmentary, plan view similar to FIG. 13 but showing the strip attached to the blanks.
Figure 14:
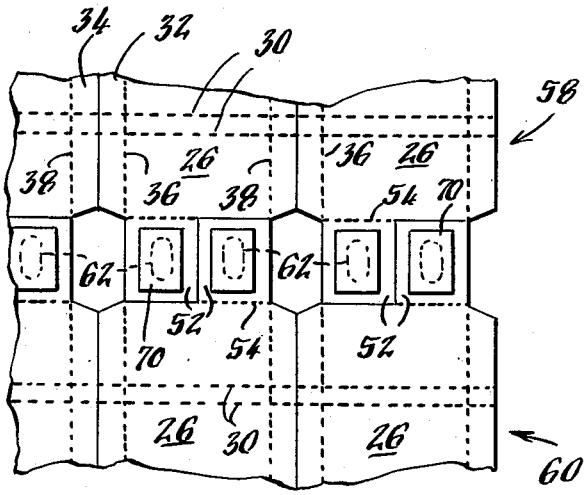
Figure 15:
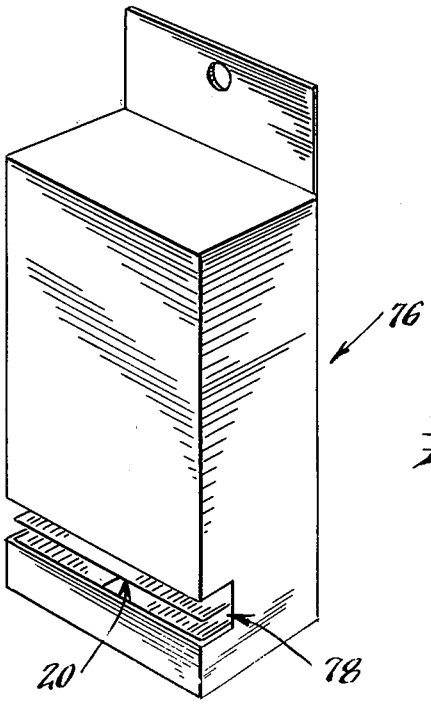
FIG. 15 is a perspective view of a dispenser filled with a plurality of the packages of the present invention, for individually dispensing the same.

The folding and unfolding sequence then proceeds as described heretofore in connection with FIGS. 6 to 12. The blanks 80 may also be cut and combined into packages 20, as illustrated in FIGS. 13 and 14 and dispensed from a dispenser 76 as illustrated in FIG. 15.

From the foregoing, it is apparent that the present invention not only provides for the reliable accomplishment of the objects of the invention but does so in a particularly simply and effective manner. Those skilled in the art will recognize, however, that various modifications or additions to the preferred embodiment chosen to illustrate the invention may be made without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A package comprising paperboard and adapted for containing a preselected amount of a product therein, said package being usable as a cup and comprising:

(a) a pair of side walls joined along mutual edges thereof to define a cup;

(b) a top edge of each of said side walls being unattached to each other to define an open mouth for said cup;

(c) a support flap connected along a first fold line to one of said top edges of said side walls and extending therefrom;

(d) packaging means secured to one face of said support flap for containing said product;

(e) a pair of closely spaced additional parallel fold lines laterally traversing each of said side walls to divide said side walls into equal portions thereby dividing said cup into opposite halves;

(f) said support flap being folded about said first fold line against one of said side walls; and (g) said side walls being folded about said additional fold lines so as to sandwich said support flap and said packaging means between said opposite halves of said cup.

* * * * *